US006050902A

United States Patent [19]

McCrink Jr.

[11] Patent Number: 6,050,902

[45] Date of Patent: Apr. 18, 2000

[54] GOLFER'S STANCE-TO-TARGET ALIGNMENT SYSTEM

[76] Inventor: Edward J. McCrink Jr., 1222 Triumphal, Santa Ana, Calif. 92705

[21] Appl. No.: 09/009,984

[22] Filed: Jan. 21, 1998

[51] Int. Cl.[7] ..... A63B 69/36

[52] U.S. Cl. ..... 473/168; 473/160; 473/172; 473/279; 473/409

[58] Field of Search ..... 473/167, 168, 473/279, 160, 172, 409

[56] References Cited

U.S. PATENT DOCUMENTS

| | | | |
|---|---|---|---|
| D. 190,241 | 5/1961 | Miller | D34/5 |
| D. 195,264 | 5/1963 | Miller | D34/5 |
| D. 308,087 | 5/1990 | Buffey | D21/234 |
| D. 335,696 | 5/1993 | Byers | D21/234 |
| D. 353,864 | 12/1994 | Thompson | D21/234 |
| D. 359,336 | 6/1995 | DeLapp | D21/234 |
| D. 366,302 | 1/1996 | Marsh | D21/234 |
| 2,577,690 | 12/1951 | Reach | 473/168 |
| 2,786,683 | 3/1957 | Shapiro | 273/183 |
| 3,464,703 | 9/1969 | Vallas | 473/168 X |
| 3,542,369 | 11/1970 | Anderson | 273/186 |
| 3,784,208 | 1/1974 | Weygandt | 273/183 A |
| 3,992,013 | 11/1976 | Golden | 273/186 D |
| 4,248,431 | 2/1981 | Burnes | 273/187 R |
| 5,004,243 | 4/1991 | Dlouhy | 273/195 A |
| 5,156,398 | 10/1992 | Kibamoto | 273/187.1 |
| 5,333,875 | 8/1994 | Wilson | 273/187.1 |
| 5,340,109 | 8/1994 | Miller | 273/186.1 |
| 5,415,407 | 5/1995 | Beatty | 273/187 R |
| 5,478,082 | 12/1995 | De Knight | 273/187 R |
| 5,558,334 | 9/1996 | Roche | 473/279 |

*Primary Examiner*—George J. Marlo
*Attorney, Agent, or Firm*—Timothy J. King

[57] ABSTRACT

The present invention provides devices, systems and methods for aiding a golfer in properly aligning his stance prior to hitting a golf ball at any one of a plurality of pre-sighted targets; the principal feature of the invention is a golf mat designed to be pivotally attached to a support surface and having a pattern of lines visible to the golfer, the pivotal lines and mat positioned with respect to a plurality of pre-sighted targets so the golfer may properly align has stance prior to hitting a golf ball at the target.

3 Claims, 8 Drawing Sheets

GOLFER'S STANCE-TO-TARGET ALIGNMENT SYSTEM

BACKGROUND OF THE INVENTION

The present invention relates to a novel method and related devices for providing a golfer a means for accurately aligning his stance prior to hitting a golf shot at a pre-selected target. More specifically, this invention relates to golf mats for use at driving ranges that allow the golfer to correctly align their stance for hitting a golf ball at a pre-selected target on the golf range.

A variety of golf teaching aids is available to golfers to aid them with their swing. Golf indicating devices, feet and ball positioning devices for golfers and other structures relating to golf instruction improvement means are known in the art. Yet, such devices are generally cumbersome, expensive or too unwieldy to provide adequate instruction. Alternatively, some devices are too complicated as they attempt to correct too many problems at once. Some of the devices taught by the art are provided below.

Wilson, U.S. Pat. No. 5,333,875 provides an alignment system for golf ball driving and hitting mat. This device teaches the golfer how to align the club head with the golf ball.

Beatty, U.S. Pat. No. 5,415,407, provides a device that attaches to the ground and aids the golfer in standing and addressing the ball. This device comprises strips or tapes that are fastened to the ground.

Weygandt, U.S. Pat. No. 3,784,208, discloses a pliant shape-holding mat having generally the shape of an elongated isosceles triangle for use by golfers. Like Wilson, it provides the golfer a point of reference in aligning the club head with the golf ball.

The art also provides designs for golf mats. Marsh, et al., U.S. Design Pat. No. D366,302, provides a design for a golf swing alignment mat. Buffey, U.S. Design Pat. No. D308,087, provides a design for a golf practice mat.

Despite the plethora of devices available to the golfer in setting their stance, there presently is no device which teaches a golfer, and particularly a neophyte golfer, how to position accurately their feet with respect to number of targets at which they intend to hit golf balls. Indeed, while golf practice ranges provide a variety of exact targets to aim at, there is a lack of an exact means to align shots to these targets. It should be noted that two of the most basic fundamentals of pre-swing preparation for golf shots are: 1) aligning the intended flight of the ball to the target, and 2) having accomplished this, then aligning the stance to the ball. Failure to isolate and address these two fundamental steps results in a great deal of mystery to the golfer when his/her errant golf shots goes far right or left of the intended target. Not having mentally isolated the real problem (and therefore the correct solution), the anxious golfer then unwittingly begins to make various adjustments and "corrections" to his/her swing to counter-act the incorrect alignments. However, the "corrections" are very deceptive. Although they may straighten out the golf shots and have the appearance of improving the golfer's game, in actuality, they violate other fundamentals of a sound golf swing. Trained in over time, these improper corrections become bad habits with a resultant lower level of play for the individual and a lower level of play for the sport at large. What is needed for golf practice ranges is a device which will provide a golfer with a sure and accurate means of aligning golf shots and the golfer's stance to a plurality of targets.

Another shortcoming of prior art golf teaching devices is that they are unsuitable for golf practice ranges. Unwieldy devices may not fit within the small confines of a golf mat. Flimsy devices will not stand up to the rigors of a practice range. Another problem, albeit one for the range owner, is that the use of unwieldy or time-consuming devices slow the golfer down while at the range. Range owners recognize the utility of golf training devices but use of such devices generally results in a slower turnover of the hitting mats and therefore a reduction of revenues and profitability.

What is needed is a durable device for golf practice ranges that will quickly, easily and safely provide a golfer with a precise means to align his/her shots and stance to a plurality of targets.

SUMMARY OF THE INVENTION

The present invention solves the problems of the prior art by providing a golfer with a device that allows him or her to accurately align the shot and the stance to a plurality of targets. The device is suitable for use at golf ranges that have a variety of pins at varying distances for the golfer to target. Specifically, the present invention provides a golf training device that aids a golfer in aligning his stance and shot, the device comprising a golf mat adapted for pivotal attachment to a support surface, the mat further characterized by a pattern of lines on the top surface of the mat.

The present invention further provides a golf-training device that aids a golfer in aligning his stance with respect to a plurality of targets; each of the targets corresponding to a pre-sighted setting. This device comprises a golf mat adapted for pivotal attachment to a support surface with the mat including a pattern of lines on the top surface of the mat and an alignment indicator fixed to the mat, whereby the mat and the pattern of lines can be positioned with respect to the pre-sighted settings such that the golfer can properly align his stance with respect to the targets by aligning the alignment indicator with the desired pre-sighted setting.

The present invention further provides a system for assisting a golfer in aligning his shot and his stance with respect to a pre-sighted target and a golf ball, the system comprising a mat pivotally attached to a support surface and having a pattern of lines visible to the golfer; an alignment indicator fixed to the mat; a pre-sighted target, at which the golfer will attempt to hit a golf ball; and an alignment gauge located substantially near the alignment indicator, whereby when the indicator and pre-sighted setting on the alignment gauge are aligned, the grid pattern is orientated such that the golfer will be able to align his stance and shot to the pre-sighted target.

The present invention further provides a method for aligning a golf shot with respect to a target, the method comprising utilizing a golf mat that is pivotally rotatable and has a grid pattern of lines, pivotally rotating the mat such that the pattern of lines on the mat provide the golfer with a visual reference to the intended line of flight and a visual reference points for a proper stance with respect to the target and the ball; placing the ball down on the mat; and aligning the golfer's stance with respect to the target and the ball.

DETAILED DESCRIPTION OF THE INVENTION

Figure 1:
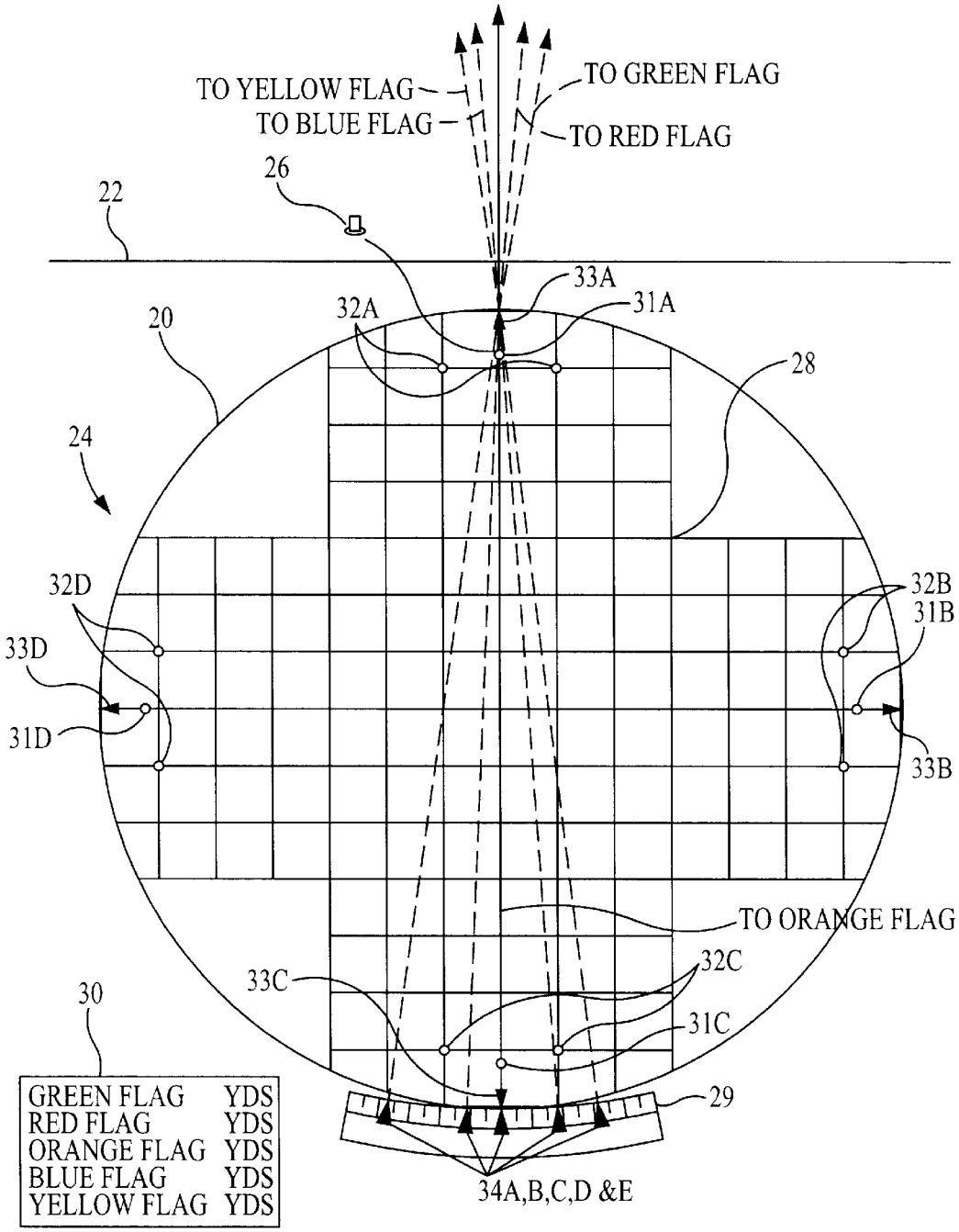
FIG. 1 illustrates a top view of a golf mat of the present invention in combination with an alignment gauge. This mat allows for use of the mat in four basic orientations to allow for maximum use of the mat.

The present invention provides numerous adaptations of a golf-training device that aids a golfer in aligning his stance and shot. The central focus of the device is a golf mat adapted for pivotal attachment to a support surface, the mat further characterized by a pattern of lines on the top surface of the mat. For purposes of this invention, the term "support surface" can include wood, pavement, concrete, grass or dirt and the term suggests that the golf mat can be used any where but it is preferably used at the golf range.

In order to extend the useful life of the mate, it is preferred that it have a shape which allows the owner of the mat to rotate it so that it wears fairly evenly. Preferably, the device has four basic orientations and it is preferable therefore that the number of sides of the mat be divisible by four. While the length of the sides need not be equal, it is preferable that the length of the sides be substantially equivalent.

The pivotal attachment of the present invention may be achieved by the use of a variety of means, such a stud fixed to the mat or the attachment of a ball and socket joint to the underside of the mat. It is preferable that the pivotal attachment includes a stud secured to the support surface. In another embodiment, the stud is fixed to the ground and the mat includes a pivotal attachment with means for receiving the stud. The means can include a ball of a ball and socket joint, or some other device designed to receive the stud. This adaptation is particularly beneficial as it allows the golf range owner to fix a stud or pivot post into the support surface, thereby allowing quick maintenance on the mat for either changing the pivotal attachment of the mat or removing a worn mat from the range. Because it is envisioned that the mat will have four orientations so it can be used completely, it is preferable that the mat be adapted for pivotal attachment at a plurality of locations.

In another adaptation of the present invention, the mat is circular in shape. When the mat is circular, the pivotal attachment may be placed in the center or near the outer edge of the mat. For purposes of the present invention, the term "pivotally attached" includes rotatable as well as pivotal attachment.

In a preferred embodiment of the present invention, when the mat is aligned to a target, the pattern of lines includes a line that is directly aimed at the target and another line that is perpendicular to this line. It is envisioned that the pattern, whether the pattern consists of two lines or the more sophisticated grid patterns discussed below, may be painted, chalked, woven into, inlaid, silks-screened or otherwise affixed to the top surface of the mat. With respect to the pattern of lines, it is preferable that it be a grid of lines, with such grid at least containing two sets of lines at right angles to the other. It is preferable that a grid be positioned on the mat with respect to the pivotal attachment in a manner such that when the mat is aligned with a target, one set of grid lines is substantially parallel with an intended line of flight and the other set of grid lines is substantially perpendicular to the intended line of flight. Preferably, the grid consists of squares.

The present invention provides a golf training device that aids a golfer in aligning his or her stance with respect to a plurality of targets, each of which corresponds to a pre-sighted setting, the device comprising: a golf mat adapted for pivotal attachment to a support surface, the mat further characterized by a pattern of lines on the top surface of the mat and an alignment indicator fixed to the mat, whereby the mat and the pattern of lines can be positioned with respect to the pre-sighted settings such that the golfer can properly align his stance with respect to the targets by aligning the alignment indicator with the desired pre-sighted setting. For purposes of the present invention, the term "pre-sighted setting" indicates that the mat has been aligned with a plurality of targets and each of those alignments is established as a setting. For example, if three targets were spread out over a range, each target would have a pre-sighted setting on the alignment gauge. The alignment gauge would provide three settings that correspond with each target. Pivoting the mat so the alignment indicator is aligned to a chosen setting on the alignment gauge would result in the mat being properly aligned with the target that corresponds with the setting.

In a preferred embodiment, the grid is situated on the mat such that when the mat alignment indicator is aligned with the pre-sighted setting, one set of grid lines is substantially parallel with an intended line of flight and the other set of grid lines is substantially perpendicular to the intended line of flight. The mat alignment indicator may be a mark on the topside surface of the mat or be attached to the mat.

A system for assisting a golfer in aligning his stance and his shot with respect to a pre-sighted target and a golf ball, the system comprising a mat pivotally attached to a support surface and having a pattern of lines visible to the golfer; an alignment indicator fixed to the mat; a pre-sighted target, at which the golfer will attempt to hit a golf ball; and an alignment gauge located substantially near the alignment indicator, whereby when the indicator and a gauge setting are aligned, the grid pattern is orientated such that the golfer will be able to use this grid pattern to align his shot and stance. In a preferred embodiment, the system further comprises a plurality of pre-sighted targets and the alignment gauge further comprising a setting that corresponds to each pre-sighted target, whereby the alignment of one setting on the gauge with the mat indicator will result in the golfer selecting the target that corresponds to that gauge setting.

In a preferred embodiment of the present invention, the alignment gauge includes incremental index lines that correspond to distance off-sets from the pre-sighted settings. For the purposes of the present invention, the term "distance off-sets" refers to distances to the right or left of the selected target. For example, each index line to the left or right of a pre-sighted setting might represent a distance off-set of five yards to the left or right of the target. Of course, if a standard alignment gauge is used, the distance off-set accorded each index line will vary with the distance of the gauge to the target. In such circumstances, it would be beneficial for the value of the distance off-sets be posted for the golfer. Using these index lines, the golfer can make minor alterations in his/her intended line of flight to adjust for such factors as winds blowing across the intended line of flight or shots practice with an intentionally curved line of flight such as a "hook", "slice", "draw" or "fade" shots.

The present invention also discloses a method for a golfer to accurately align his shot and stance with respect to a target. The method comprises choosing a pre-sighted target; rotating the mat so that the alignment indicator is aligned to the appropriate pre-sighted setting; placing a ball down on the mat at the perpendicular intersection of two lines; using the pattern of lines as a visual reference points to then adjust his stance in relationship to the ball.

DESCRIPTION OF THE EMBODIMENTS

FIG. 1 provides the golf mat 20 of the present invention positioned on a support surface 24. The leading edge 22 of the support surface marks the forward edge of the space that the golfer can use in hitting golf balls. An aperture 31A is positioned to receive a stud 26 that is fixed to the support surface 24. Tees may be fitted within apertures 32D (for a left-handed golfer) or in apertures 32B for a right handed golfer. Such tees are not necessary for the invention as the golfer can hit iron shots off the mat 20.

The plaque 30 provides the golfer with the distances for each of the respective targets available to him. Preferably, each of the pre-sighted settings 34 A, B, C, D and E are color coded with the flag colors indicated on the plaque 30. To use the mat, the golfer must pivot the mat 20 on the stud 26 so the alignment indicator 33C is aligned to a pre-sighted setting 34C. 34C correspond with the orange flag. The result is that the golfer has precisely lined up his shot with the orange flag and thereby removed one important variable prior to beginning his practice shots: the correct alignment of his shot with the intended target.

Next, the golfer would place his ball on the tee fixed within apertures 32D (lefty) or 321B (righty). The golfer would then be able to position his feet with respect to the ball. The pattern of lines 28 would provide the golfer with many points of reference.

With the preferable grid pattern, if desired, the golfer would be able to line up his feet such that they are substantially perpendicular to the intended line of flight. Accordingly, the present invention provides a second benefit: insuring that the position of the golfer's feet with respect to the line of flight is correct.

In addition to adjusting the positioning of his feet, other adjustments will be facilitated by the present invention. The present invention further provides the golfer with the ability to precisely alter his stance posture to determine such changes on his swing. Some of these characteristics include the following: the golfer will know how far the ball is from toe of his shoe; he will know whether the ball is being played in front of, behind or in the center of his stance; the distance between the feet, at the toes and the heels, will be apparent; use of an open, closed or square stance will be apparent; whether the hips are open, square or closed will be apparent; whether the knees are open, square or closed will be apparent; whether the shoulders are open, square or closed will be apparent; and the lines can be use as a guide for the desired path of the club head when it makes contact with the ball and thereby correct a swing that is not outside in or too inside out.

One characteristic of the mat 20 is that it is designed to be rotated so it can provide longer life. Shifting the aperture from 31A to 31B, for example, would allow for a different portion of the mat 20 to be used. Longer life to the mat 20 would lessen the expense of the owner of the golf range.

Figure 2:
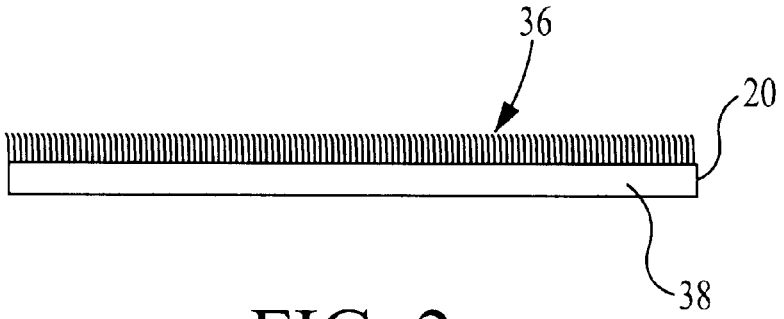
FIG. 2 is a side view of a mat of the present invention.

FIG. 2 provides a side view of the mat 20 of the present invention. In this embodiment, the mat 20 is composed of Astroturf that generally has a grass-like surface 36 that is support by a pliable support 38. While Astroturf is the preferable surface for the mat, it is conceivable that operators would use carpeting or mats made entirely from rubber.

Figure 3:
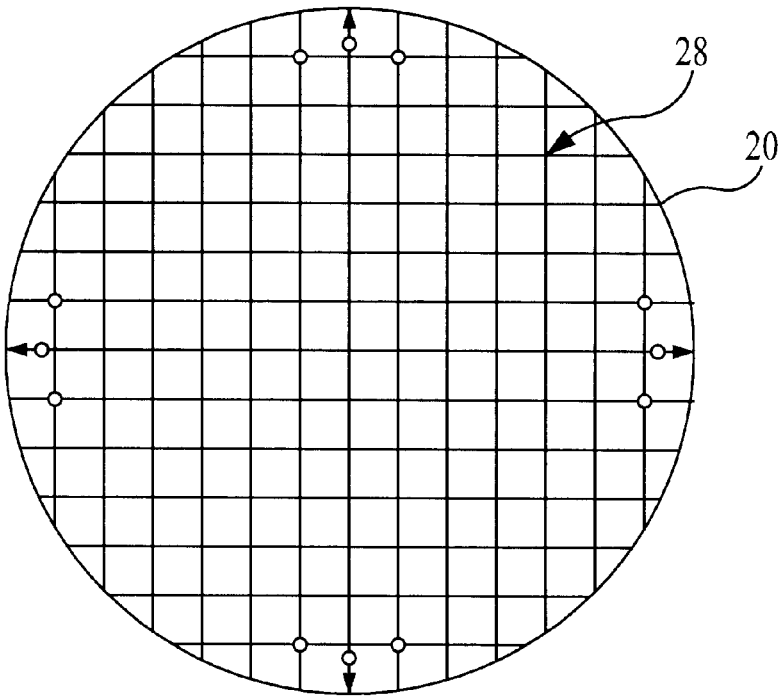
FIG. 3 is top view of the mat of FIG. 1 without the alignment gauge where the grid covers the entire surface.

FIG. 3 provides the mat 20 that is circular and is entirely covered by a grid of lines 28. It is envisioned that if the lines are woven into the mat 20, use of this embodiment will be less expensive than that provided in FIG. 1.

Figure 4:
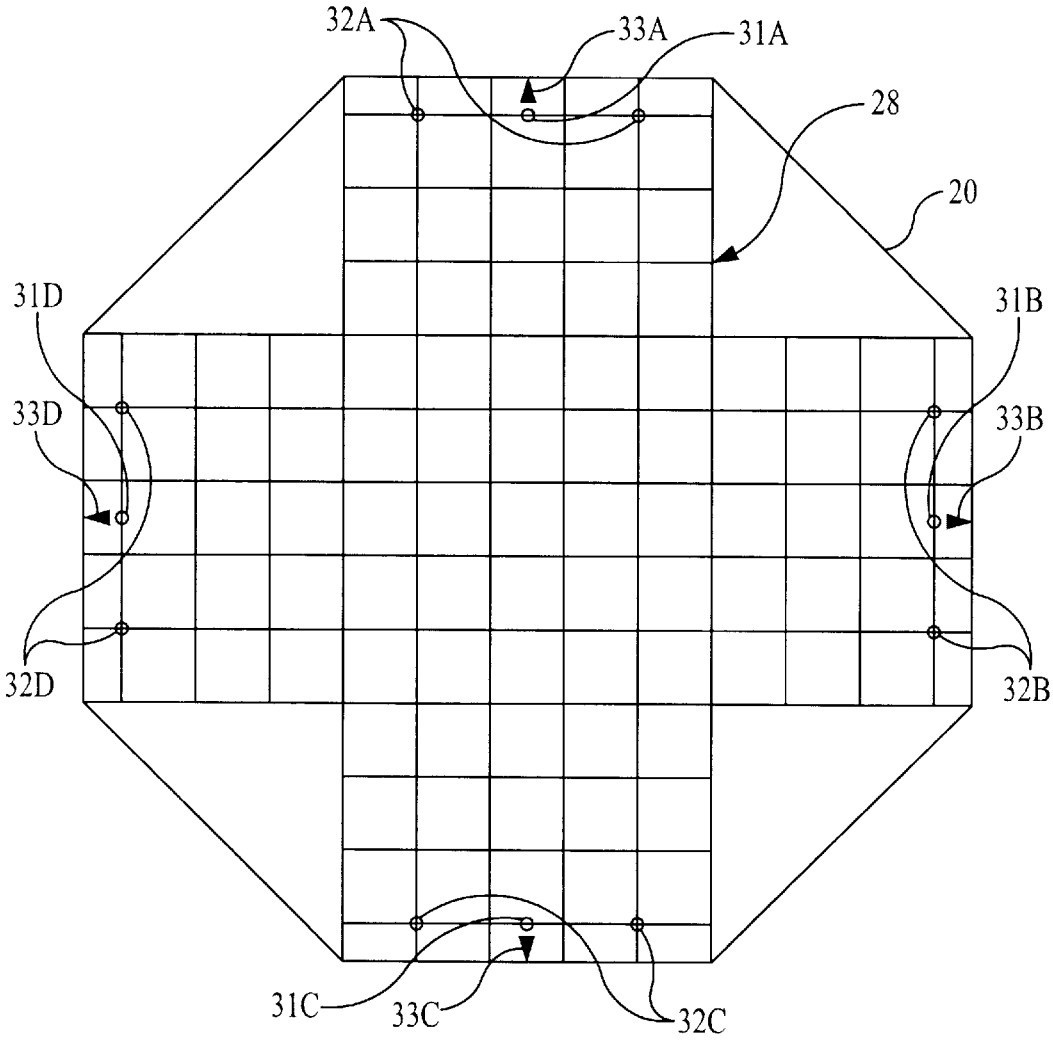
FIG. 4 is a top view of a mat that is octagonal.

FIG. 4 provides the mat 20 that is octagonal in shape.

Figure 5:
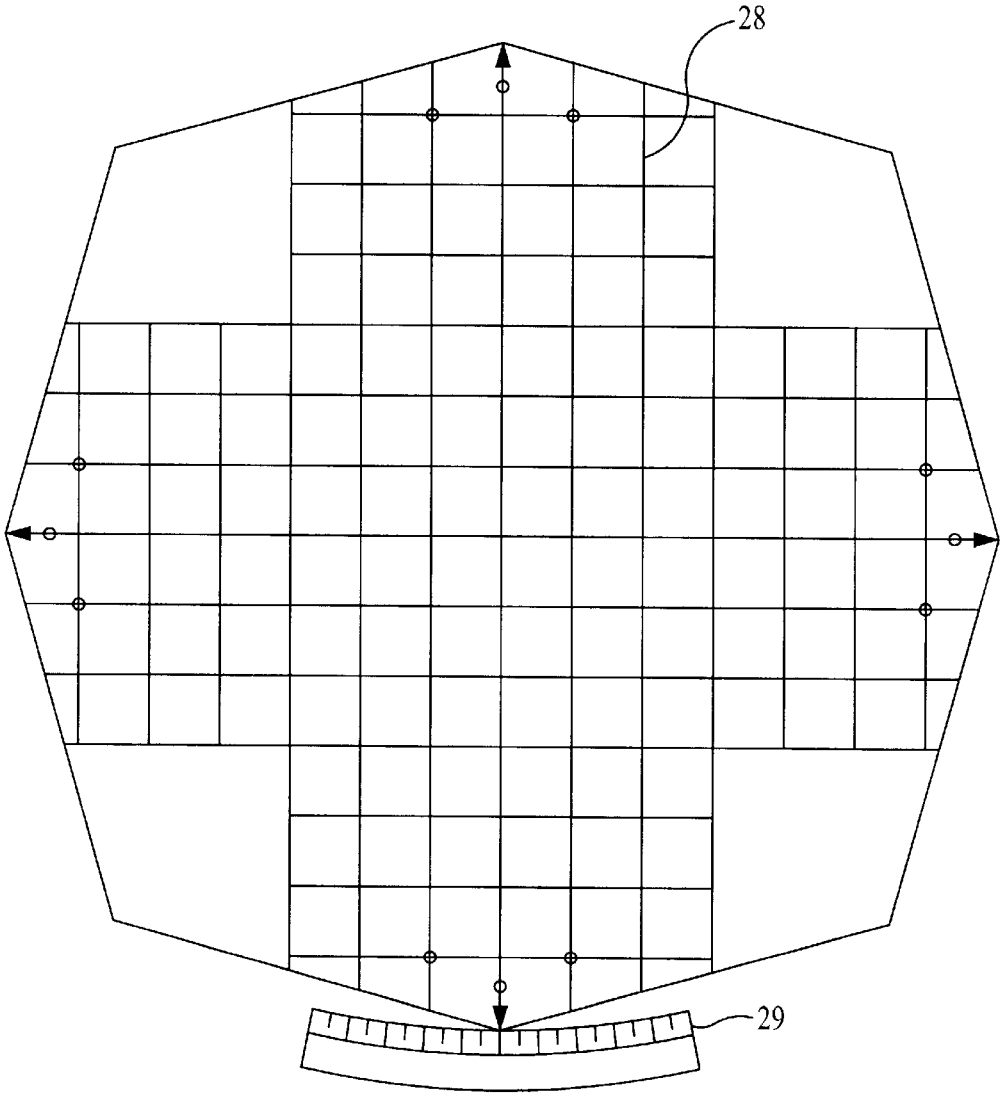
FIG. 5 is a top view of the mat and an alignment gauge.
Figure 6:
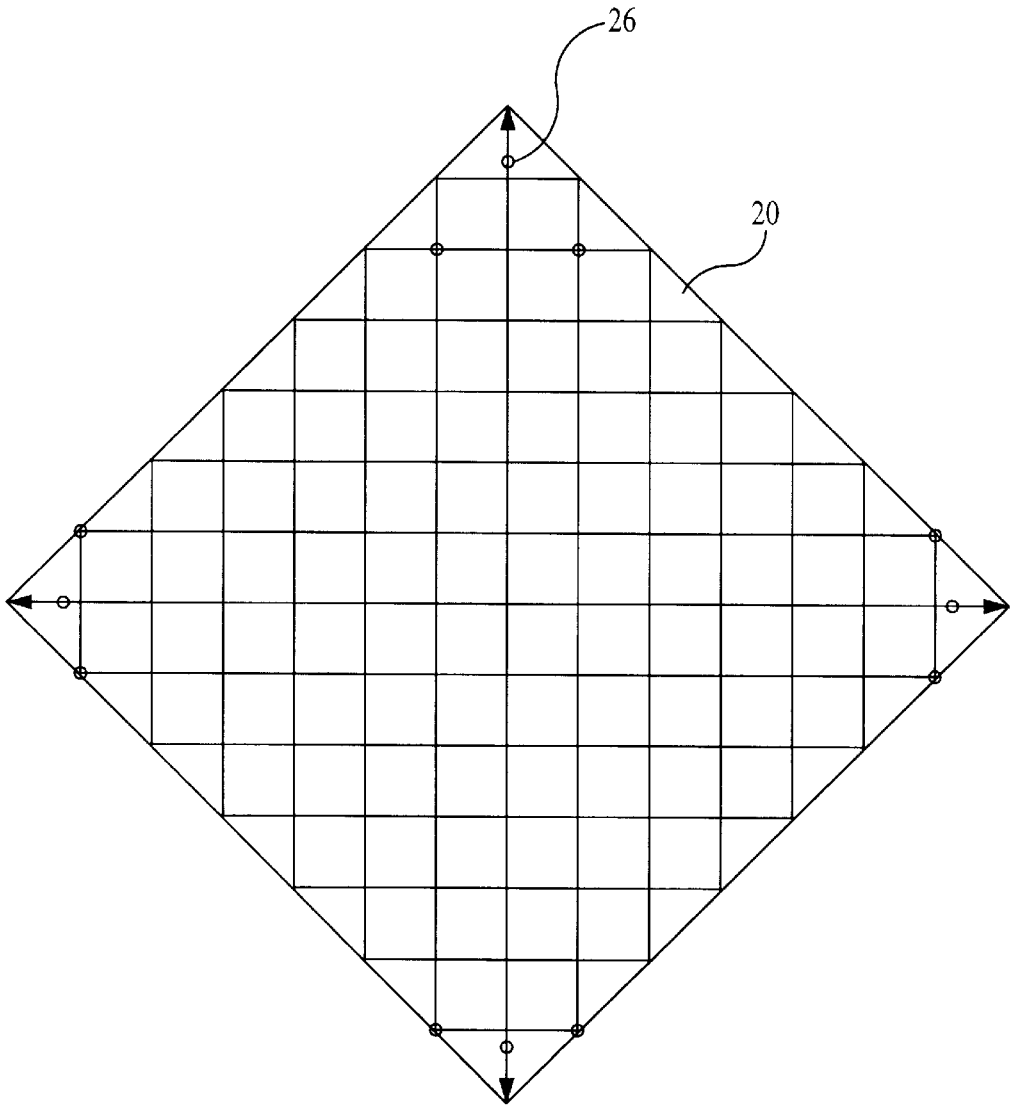
FIG. 6 is a top view of the mat that is square and where indicators are positioned at each corner.

FIG. 5 provides the mat of FIG. 4 as well as an alignment gauge 29. FIG. 6 provides the mat 20 in the shape of a square. Notice the mat 20 pivots on a stud 26 that is positioned in the corner of the mat 20. This design provides less of a profile that the other mats.

Figure 7:
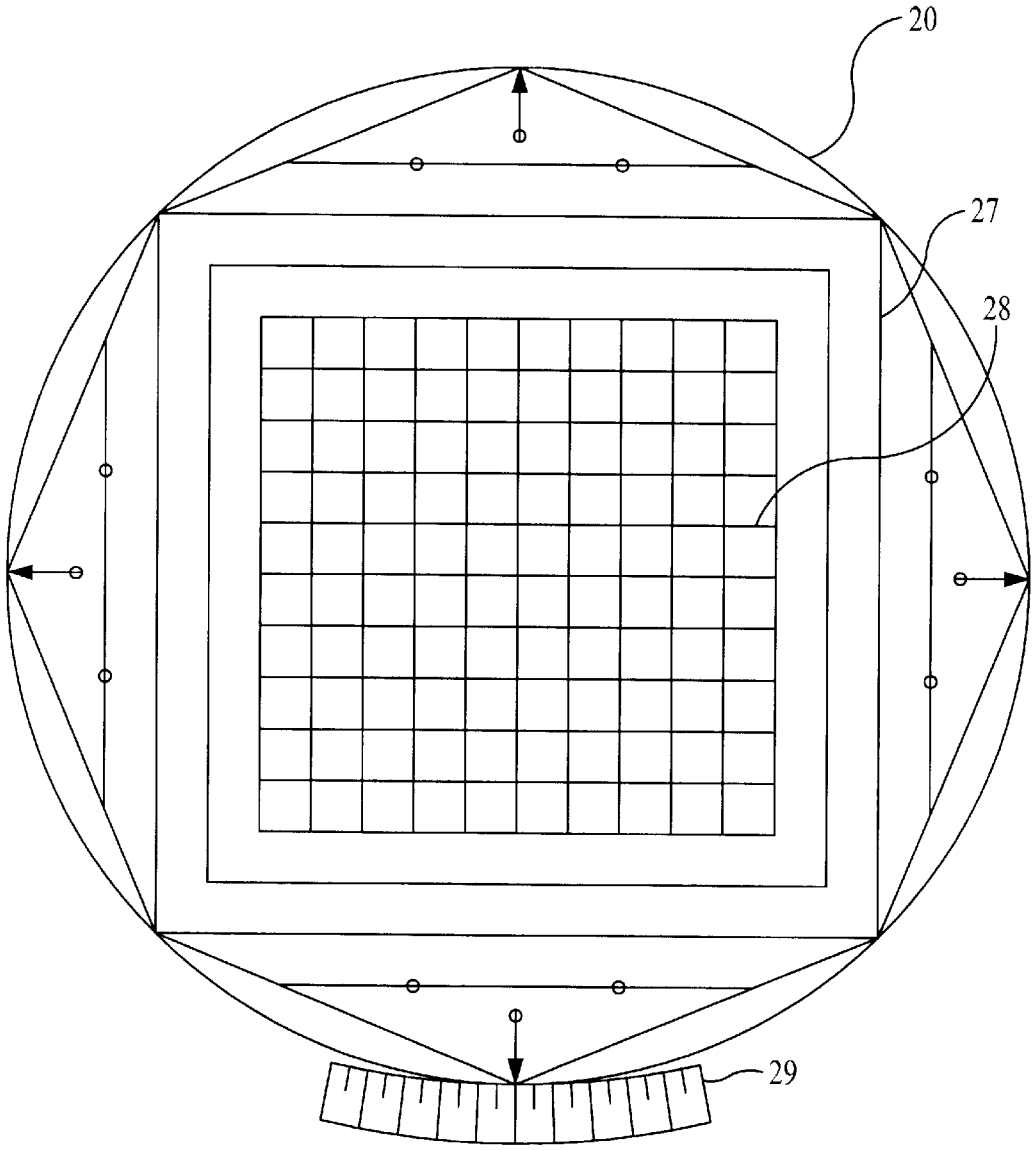
FIG. 7 is a top view of the mat wherein the pattern of lines for positioning the feet is distinct from the pattern of lines on which the ball is located.

FIG. 7 provides a mat 20, alignment gauge 29, grid pattern of lines 28 and a separate line 27 designed for aligning the golfer's shot when he uses a driver.

Figure 8:
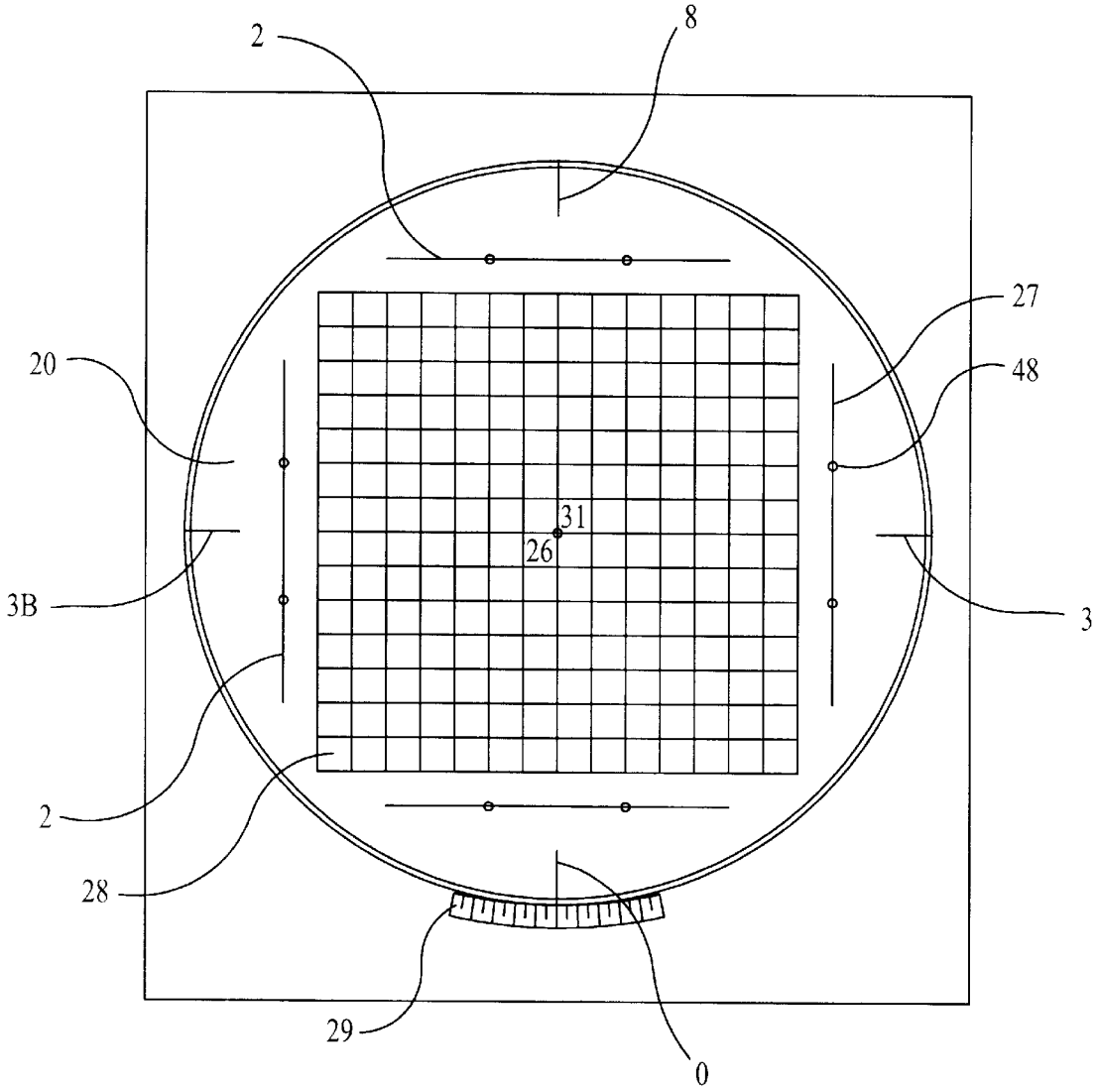
FIG. 8 is a top view of the mat wherein the mat is circular and pivots at its center.

FIG. 8 provides a golf mat 20 that pivots in the center. This figure provides a square outline, to the recessed circular-hitting surface, but such outline is not needed. The alignment plate 29 may be fixed to the support surface 24 or to this outline.

Figure 9:
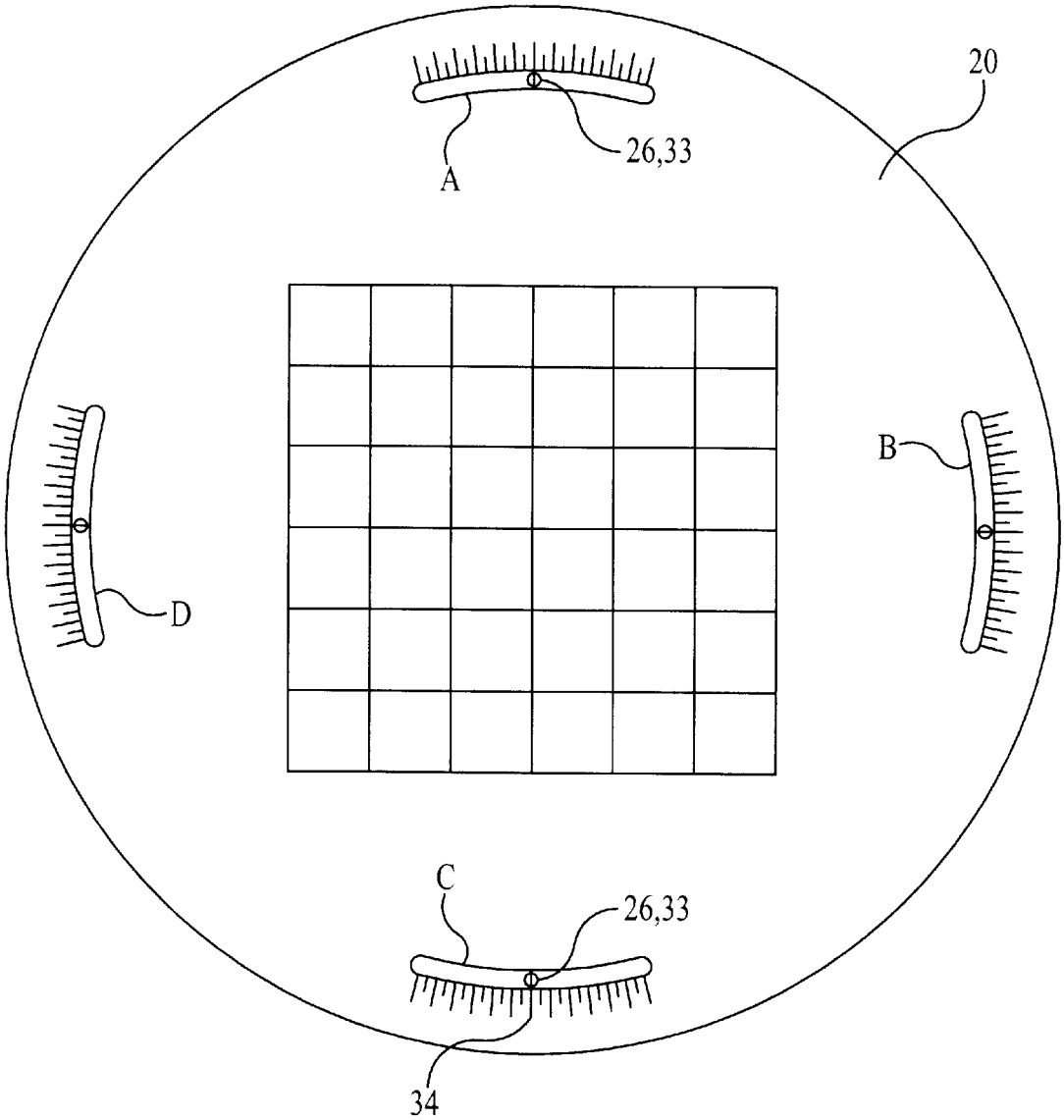
FIG. 9 is a top view of the mat wherein the mat is circular and the alignment gauge is included on the surface of the mat and the alignment indicator is fixed to the support surface.

FIG. 9 provides a mat 20 wherein the alignment gauge 29 is fixed to the mat and there is a plurality of studs 26 fixed to the support surface 24. The studs serve as alignment indicators as well as studs 26. In this embodiment of the invention, the alignment indicators are juxtaposed in slots 50 in the mat 20. The mat is rotated, rather than pivoted, to align the pre-sighted setting 34 with the alignment indicator 33.

In order to install one embodiment of the present invention in a practice range, the positions of the various targets in the range would have to be fixed and made permanent. Preferably, the targets would be a different distance and thereby provide the golfer with the ability to use most of the clubs in his golf bag.

One of ordinary skill in the art will be able to appreciate the requirements for setting up the mat of FIG. 1. With respect to calibrating the targets with the settings on the alignment gauge, one of ordinary skill in the art would appreciate that each of such settings must be properly aligned. The inventor contemplates the use of standard surveying equipment, such as lasers.

After calibration, the distances will have to be determined so the golfer is given exact distances. It is envisioned that distances would be rounded up to the nearest yard, as this is the standard unit of measure on the golf course.

A variety of printed publications have been cited in this application. All such publications are herein incorporated by reference in their entirety.

Although the invention has been described in detail above, this is solely for purposes of illustration and should not be considered limiting, as modifications may become apparent to those of skill in the art without departing from the scope of the invention as defined in the accompanying claims.

I claim:

1. A system for assisting a golfer in aligning his stance and his shot with respect to a pre-sighted target and a golf ball, the system comprising:

a mat pivotally attached to a support surface and having a pattern of lines visible to the golfer;

an alignment indicator fixed to the mat;

a pre-sighted target, at which the golfer will attempt to hit a golf ball; and an alignment gauge located substantially near the alignment indicator, whereby when the indicator and gauge are aligned, the grid pattern is orientated such that the golfer will be able to align his stance and shot to the pre-sighted target.

2. The system of claim 1 further comprising a plurality of pre-sighted targets and wherein the alignment gauge further comprises a setting that corresponds to each pre-sighted target such that the alignment of one setting on the gauge with the mat indicator will result in the golfer selecting the target that corresponds to that gauge setting.

3. The device of claim 2, wherein the alignment gauge includes additional settings that correspond to distance offsets from the pre-sighted settings.

* * * * *